US007870988B2

(12) United States Patent
Schiestl et al.

(10) Patent No.: US 7,870,988 B2
(45) Date of Patent: Jan. 18, 2011

(54) HAND-HELD SPRING-DRIVEN DRIVE-IN TOOL

(75) Inventors: Ulrich Schiestl, Hohenems (AT); Robert Spasov, Schaan (LI); Karl Franz, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 126 days.

(21) Appl. No.: 12/316,541

(22) Filed: Dec. 12, 2008

(65) Prior Publication Data

US 2009/0152321 A1 Jun. 18, 2009

(30) Foreign Application Priority Data

Dec. 14, 2007 (DE) ..... 10 2007 060 425

(51) Int. Cl.
*B25C 1/06* (2006.01)

(52) U.S. Cl. ..... 227/132; 227/139; 227/131

(58) Field of Classification Search ..... 227/132, 227/139, 108, 135, 131; 172/202, 203
See application file for complete search history.

(56) References Cited

U.S. PATENT DOCUMENTS 1,767,485 A * 6/1930 Shallenberger ..... 227/147
1,845,617 A * 2/1932 Metcalf ..... 227/96
3,305,156 A * 2/1967 Khan ..... 227/132
3,589,588 A * 6/1971 Vasku ..... 227/132
3,847,322 A * 11/1974 Smith ..... 227/132
3,982,678 A * 9/1976 Olson ..... 227/63
4,103,747 A * 8/1978 Finney ..... 173/203
4,215,808 A * 8/1980 Sollberger et al. ..... 227/146
4,724,992 A * 2/1988 Ohmori ..... 227/146
7,494,037 B2 * 2/2009 Simonelli et al. ..... 227/132
7,543,728 B2 * 6/2009 Spasov et al. ..... 227/132
2007/0023472 A1 2/2007 Schiestl
2007/0284406 A1 * 12/2007 Okouchi ..... 227/132
2008/0173688 A1 * 7/2008 Spasov et al. ..... 227/8

* cited by examiner

*Primary Examiner*—Brian D Nash
(74) *Attorney, Agent, or Firm*—Abelman, Frayne & Schwab

(57) ABSTRACT

A hand-held drive-in power tool for driving in fastening elements includes a guide (12) in which a drive-in ram (13) for driving a fastening element is displaceable, and at least one preloaded drive spring (31) for driving the drive-in ram (13), with the drive being preloaded by a tensioning device (70) and further includes a transmission element (33) for transmitting a tensioning force from the tensioning device (70) to the drive spring (31), the transmission element being guided by at least one roller (34) supported on a support element (35) by at least one rolling bearing (40).

14 Claims, 4 Drawing Sheets

HAND-HELD SPRING-DRIVEN DRIVE-IN TOOL

BACKGROUND OF THE INVENTION

1. Field of the Invention

The present invention relates to a hand-held drive-in power tool for driving in fastening elements and including a guide, a drive-in ram displaceable in the guide, drive means for driving the drive-in ram and including at least one preloaded drive spring, a tensioning device for preloading the drive spring, a transmission element for transmitting a tensioning force from the tensioning device to the drive spring, at least one roller for guiding the transmission element, and a support element for supporting the at least one roller.

2. Description of the Prior Art

A drive-in tool of the type discussed above is disclosed in U.S. Patent Publication US 2007/0023472 A1. The drive-in tool includes a drive-in ram for driving in fastening elements and displaceable toward the drive-in tool mouth by a drive spring. The tensioning device for displacing the drive spring into a preloaded position includes an electric motor and a transmission element that is guided over a deflection roller. The rotational movement of the electric motor is transmitted to the drive spring by the drive-in ram and the transmission member, whereby the drive spring is preloaded.

An object of the present invention is to further improve the efficiency of a drive-in tool such as described in the above-discussed U.S. Patent Publication.

SUMMARY OF THE INVENTION

This and other objects of the present invention, which will become apparent hereinafter, are achieved by providing a rolling bearing for supporting the at least one roller on the support element. The bearing prevents sliding friction losses, which otherwise are produced between the at least one roller and the support element. The rolling bearing increases the efficiency of the entire system.

Advantageously, the at least one roller has at least one guide element for centrally axially guiding the transmission element over the at least one roller. The guide element prevents a sidewise displacement of the transmission element (i.e., displacement in the axial direction of roller) and, thereby, energy losses caused by excessive friction or a non-uniform loading of the roller.

In a constructively advantageous embodiment, the guide element is formed by guide webs provided at opposite axial ends of the at least one roller.

According to an alternative embodiment, the guide element is formed as a radial circumferential groove provided on the at least one roller, with the transmission element having a guide rib engaging in the groove.

According to another embodiment, the guide element is formed by a keg-shaped circumferential profile of the at least one roller.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
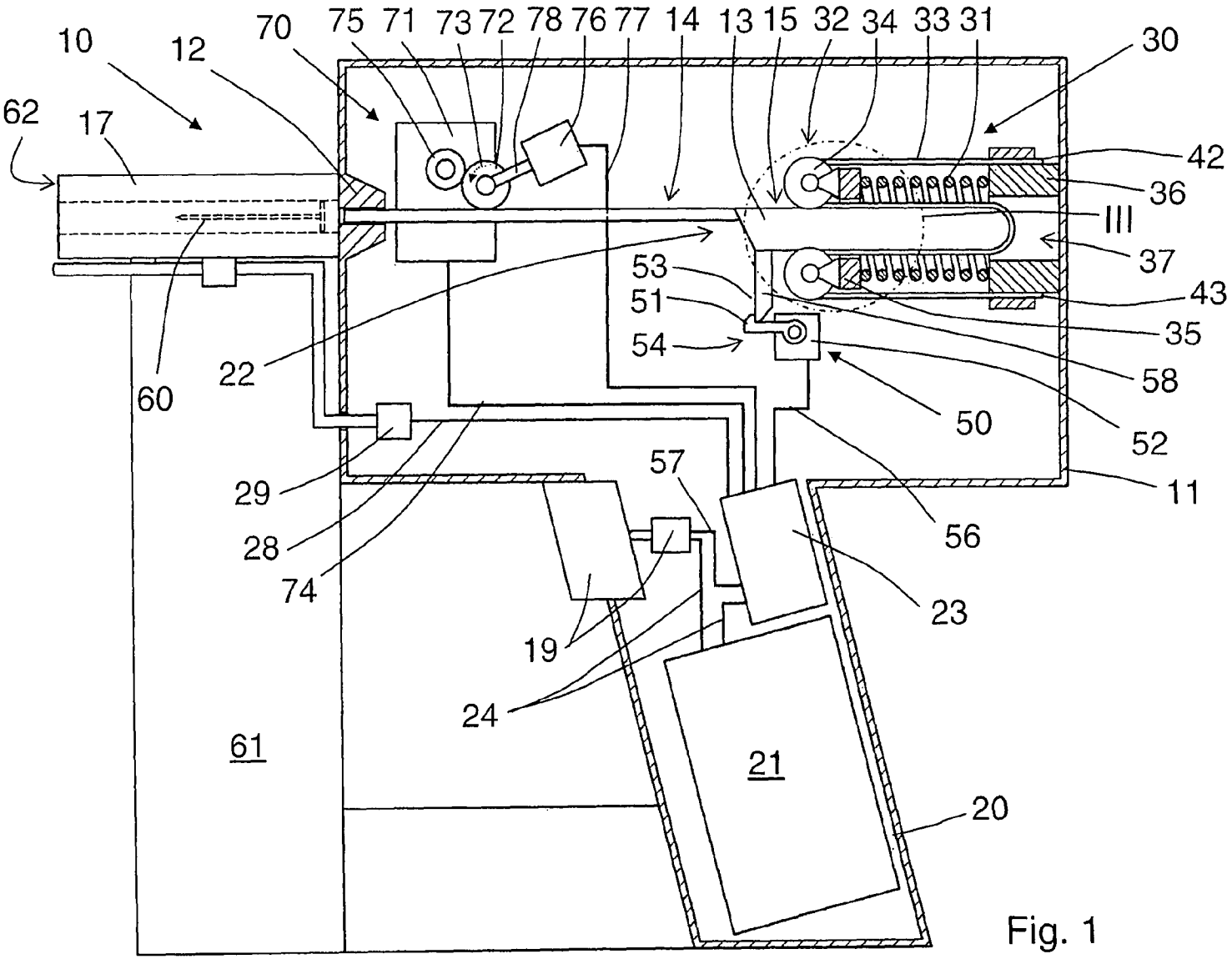
FIG. 1 a longitudinal cross-sectional view of a drive-in power tool according to the present invention in its initial position.

A drive-in tool 10 according to the present invention, which is shown in FIGS. 1-4, has a housing 11 and located in the housing 11, drive means, which is generally indicated with a reference numeral 30, for driving a drive-in ram 13 displaceable in a guide 12 likewise located in the housing 10. The drive-in ram 13 has a driving section 14 and a head section 15.

A bolt guide 17 adjoins an end of the guide 12 facing in the drive-in direction 27 and is arranged coaxially with the guide 12. Sidewise of the bolt guide 17, a magazine 61 for fastening elements is arranged. In the magazine 61, fastening elements 60 are stored.

The drive means 30 includes a drive spring 31 and a transmission mechanism, which is generally indicated with a reference numeral 32 and which engages the head section 15 of the drive-in ram 13. The driving force generated by the drive spring 31 is transmitted to the drive-in ram 13 via the transmission mechanism 32. The drive spring 31 is formed as a helical spring. The transmission mechanism 32 is formed in the embodiment shown in FIGS. 1-4 as a rope drive. The drive spring 31 is arranged between an abutment 36 fixedly secured to the housing 10 and a support element 35 which is formed as a take-off annular spring member. At an end of the take-off element 35 remote from the drive spring 31, two opposite rollers 34 are rotatably supported by rolling bearings 40, as particularly shown in FIG. 3. The rolling bearings 40 are formed, e.g., as ball bearings, with the balls forming rolling bodies 49. A rope or band-shaped transmission element 33, the first and second free ends 41, 42 of which are secured to the abutment 36, is guided by the rollers 34 about the support element 35. At the axial ends of the rollers 34, there are provided guide elements formed by guide webs 46, respectively. The guide webs 46 insure that the transmission element 33 is centrally guided over the rollers 34 (see, in particular, FIG. 4). Simultaneously, the transmission element 33 is guide about the free end of the head section 15 of the drive-in ram 13.

In the initial position 22, shown in FIG. 1, the drive-in ram 13 is resiliently preloaded by the transmission mechanism 32 against the drive spring 31. The head section 15 of the drive-in ram 13, together with the surrounding it transmission element 33, extends into a cylindrical guide chamber 37 which is defined by the support element 35, drive spring 31, and the abutment 36. With the head section 15 of the drive-in ram 13 being guided in guide chamber 37 between these elements and, in particular, within the drive spring 31, advantageously, a compact construction is obtained.

In the initial position 22, the drive-in ram 13 is held with a locking device generally indicated with a reference numeral 50. The locking device 50 has a pawl 51 that engages, in a locking position 54 (see FIG. 1), a locking surface 53 of a projection 58 of the drive-in ram 13, holding the drive-in ram 13 against the biasing force of the drive spring 31. The pawl 51 is supported on a servomotor 52 and is displaced thereby into a release position 55 shown in FIG. 2, which would be described in detail further below. An electrical first control conductor 56 connects the servomotor 52 with a control unit 23.

The drive-in power tool 10 further has a handle 20 on which there is provided an actuation switch 19 for initiating a drive-in process with the drive-in power tool 10. In the handle 20, there is further arranged a power source generally indicated with a reference numeral 21 and which provides electrical energy for the power tool 10. In the embodiment described here, the power source 21 contains at least one accumulator. The power source 21 is connected by electrical conductors 24 with both the control unit 23 and the actuation switch 19. The control unit 23 is also connected with the actuation switch 19 by a switch conductor 57.

Figure 2:
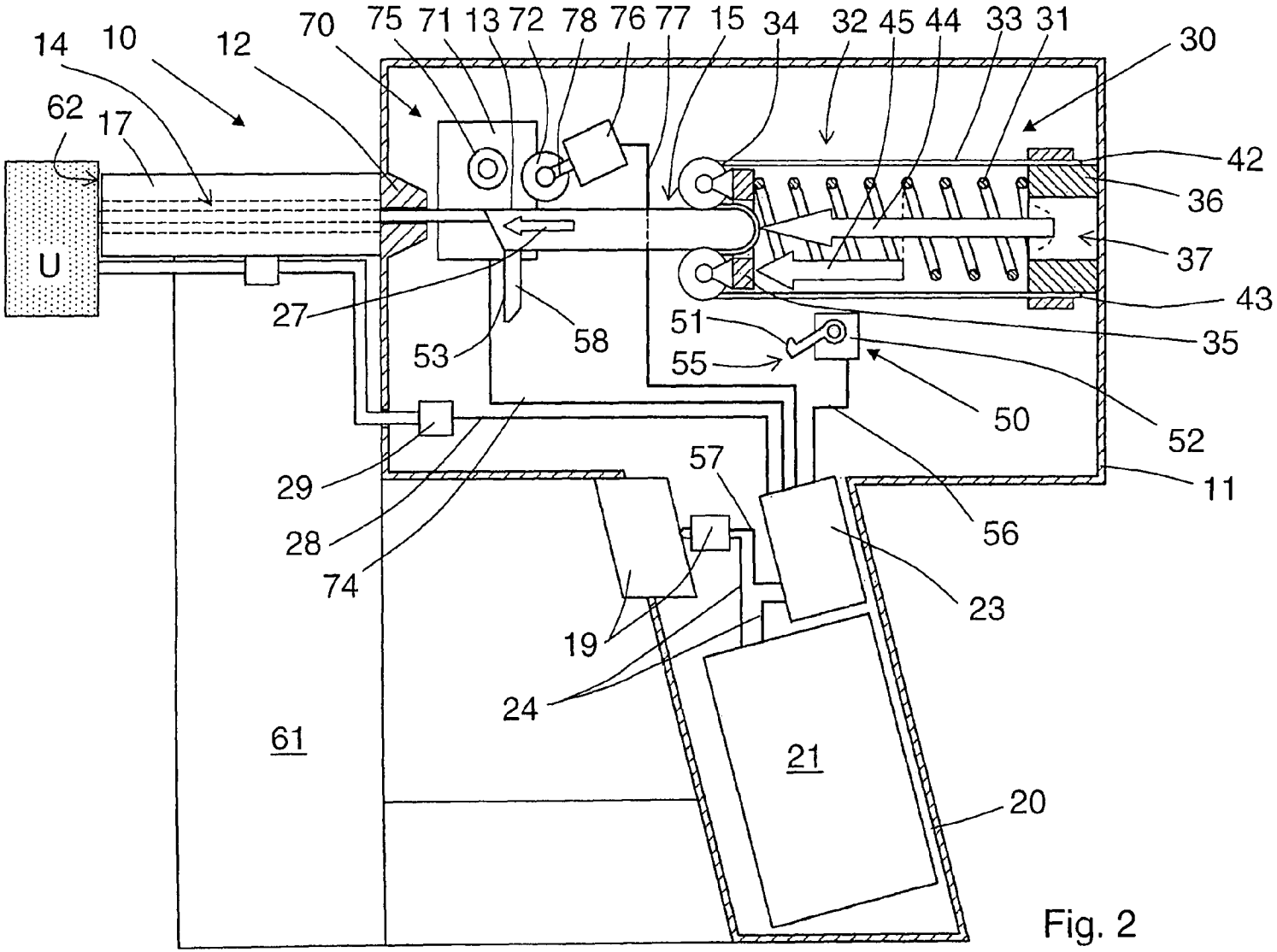
FIG. 2 a longitudinal cross-sectional view of the drive-in power tool according to FIG. 1 in its operational position.
Figure 3:
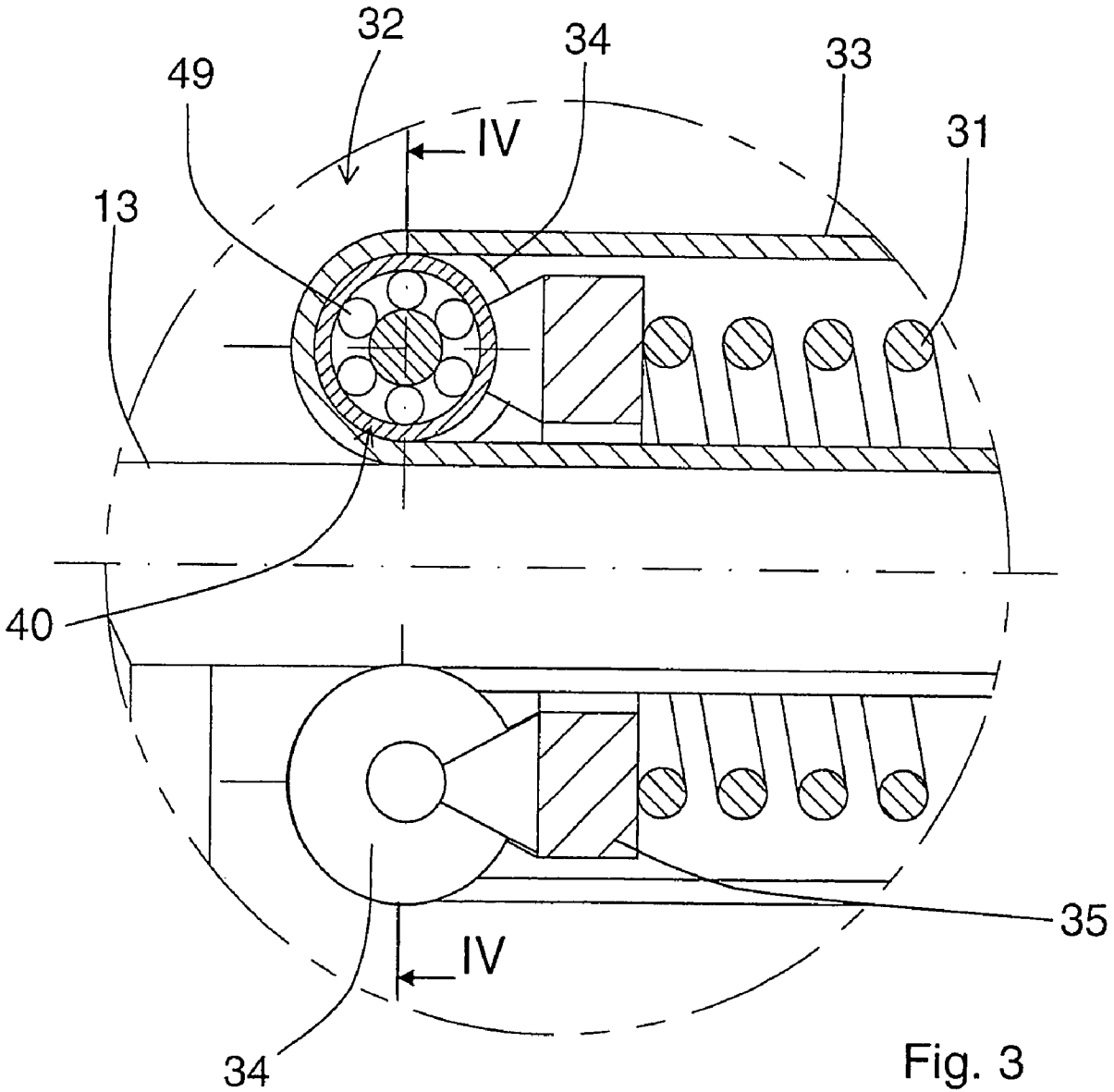
FIG. 3 a partial cross-sectional view of a detail of the drive-in power tool shown in FIG. 1 and which is marked with a reference sign III.

At a mouth 62 of the drive-in power tool 10, there is provided switch means 29 which is electrically connected with the control unit 23 by an electrical conductor 28. The switch means 29 communicates an electrical signal to the control unit 23 as soon as the drive-in power tool 10 is pressed against a constructional component U, as shown in FIG. 2, which insures that the drive-in power tool 10 only then can be actuated when it is properly pressed against the constructional component.

On the drive-in power tool 10, there is further arranged a tensioning device generally indicated with a reference numeral 70. The tensioning device 70 has a motor 71 for driving a drive roller 72. The motor 71 is connected with the control unit 23 by a second control conductor 74 and is actuated by the control unit 23 when, e.g., the drive-in ram 13 is located in its end, in the drive-in direction 27, position or when the drive-in power tool 10 is lifted off the constructional component. The motor 71 has output means 75 such as, e.g., an output gear, connected with a drive roller 72. The drive roller 72 is rotatably supported on a longitudinally adjustable arm 78 of adjusting means 76 formed as a solenoid. The adjusting means 76 is connected with the control unit 23 by an adjusting conductor 77. During the operation, the drive roller 72 rotates in a direction of arrow 73 which is shown with dash lines.

When the drive-in power tool is actuated with a main switch, not shown, the control unit 23 insures that the drive-in ram 13 remains in its initial position shown in FIG. 1. If this is not the case, then the drive roller 72 of the adjusting means 76 is displaced toward output gear 75, which is rotated by the motor 71, and engages the output gear 75. Simultaneously, the drive roller 72 engages the drive-in ram 13 which is displaced by the drive roller 72, which rotates in the direction shown with arrow 73, in a direction of the drive means 30, preloading the drive spring 32 of the drive means 30. When the drive-in ram 13 reaches its initial position 22, the pawl 51 of the locking device 50, pivoting about its axis, engages the locking surface 53 of the drive-in ram 13, retaining same in the initial position 22. Then, the motor 71 can be turned off by the control unit 23. At the same time, the adjusting means 76, under control of the control unit 23, displaces the drive roller 72 from it engagement position with the output means 75 and the drive-in ram 13 to its disengagement position (see FIG. 2).

When the drive-in tool 10 is pressed against the constructional component U, then control means 23 is shifted by the switch means 29 to its setting-in ready position. Then, when the actuation switch 19 is actuated by the tool user, the control unit 23 displaces the locking device 50 into its release position 55, whereby the pawl 51 is lifted by the servomotor 52 off the locking surface 53 of the drive-in ram 13. The pawl 51 is biased in the direction of the drive-in ram 13.

The drive-in ram 13, upon being released by the locking device 50, is displaced by the drive spring 31 of the drive means 30 in the drive-in direction 27, driving a fastening element 60 in the constructional component U. Advantageously, the expansion path (arrow 45) of the drive spring 31 is so converted by the transmission mechanism 32 that the acceleration path (arrow 44) of the drive-in ram 13 is longer than the expansion path (arrow 45) of the drive spring 31. The transmission ratio of the transmission mechanism 32 amount, in the embodiment discussed here, to 1:2.

For returning the drive-in ram 13 and for preloading the drive spring 31, at the end of the drive-in process, the tensioning device 70 is actuated by the control unit 23 when the drive-in power tool 10 is lifted off the constructional component U. Upon the power tool 10 being lifted off, the switch means 29 communicates a signal to the control unit 23. The tensioning device 70 displaces the drive-in ram 13, in a manner described above, against the drive spring 31 until the pawl 51 engages, in its locking position 54, the locking surface 53 of the drive-in ram 13.

Figure 5:
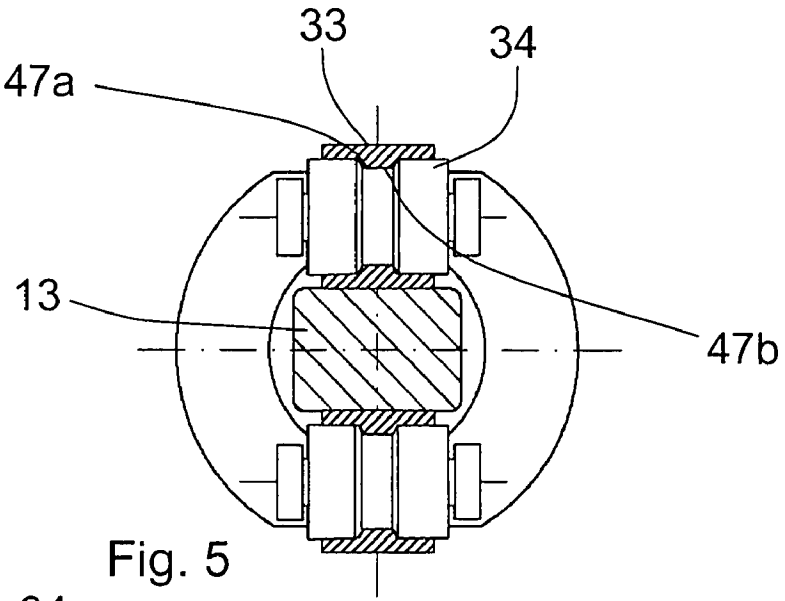
FIG. 5 a view similar to that of FIG. 4 of another embodiment of a drive-in tool according to the present invention.

A drive-in tool, which is shown in FIG. 5 distinguishes from the drive-in tool described above with reference to FIGS. 1-4 in that instead of two guide webs, which form the guide means, a guide groove 47*a*, which serves as guide means, is provided on each of the rollers 34. For centrally guiding the transmission element 33 over the rollers 34, the transmission element 33 is provided with a guide rib 47*b* that engages in the guide grooves 47*a* of the rollers 34.

Figure 6:
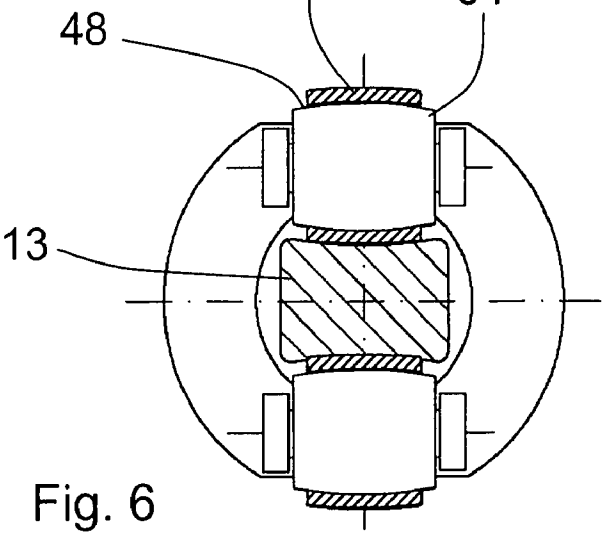
FIG. 6 a view similar to that of FIG. 4 of yet another embodiment of a drive-in tool according to the present invention.

A drive-in tool, which is shown in FIG. 6 distinguishes from the drive-in tools described above in that each of the rollers 34 has a keg-shaped circumferential profile that serves as guide means for centrally guiding the transmission member over the rollers 34.

Figure 4:
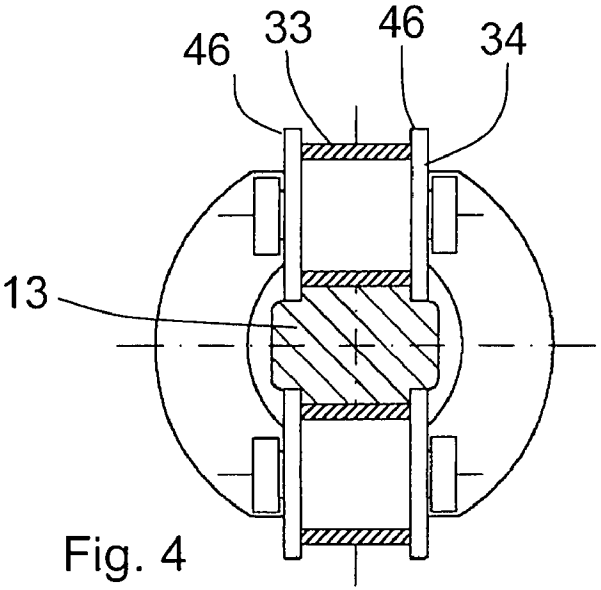
FIG. 4 a cross-sectional view along line IV-IV in FIG. 3.

Naturally, a combination of guide means shown in FIGS. 4-6 is also possible.

Though the present invention was shown and described with references to the preferred embodiments, such are merely illustrative of the present invention and are not to be construed as a limitation thereof and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A hand-held spring drive-in power tool for driving in fastening elements, comprising a guide (12); a drive-in ram (13) displaceable in the guide (13); drive means (30) for driving the drive-in ram (13) and including at least one preloaded drive spring (31); a tensioning device (70) for preloading the drive spring (31); a transmission element located between the tensioning device and the drive spring (70) (33) for transmitting a tensioning force from the tensioning device (70) to the drive spring (31); at least one roller (34) for guiding the transmission element (33); a support element (35) for supporting the at least one roller (34); and at least one rolling bearing (40) for supporting the at least one roller (34) on the support element (35).

2. A drive-in tool according to claim 1, wherein the at least one roller (34) has at least one guide element for centrally guiding the transmission element (33) over the at least one roller (34).

3. A drive-in tool according to claim 2, wherein the guide element comprises guide webs (46) provided at opposite axial ends of the at least one roller (34).

4. A drive-in tool according to claim 2, wherein the guide element comprises a radial circumferential groove (47*a*) provided on the at least one roller (34), and the transmission element (33) has a guide rib (47*b*) engaging in the groove (47*a*).

5. A drive-in tool according claim 2, wherein the guide element comprises a keg-shaped circumferential profile (48) provided on the at least one roller (34).

6. A drive-in tool according to claim 1, wherein the transmission element comprises one of rope and band.

7. A drive-in tool according to claim 1, comprising at least two rollers (34) for guiding the transmission element (33).

8. A drive-in tool according to claim 1, wherein the at least one rolling bearing (40) is formed as a ball bearing.

9. A drive-in tool according to claim 1, wherein the transmission element (33) transmits a driving force from the drive spring (31) to the drive-in ram (13) upon actuation of the drive means (30).

10. A drive-in tool according to claim 9, wherein the transmission element (33) converts expansion path of the drive spring (31) into an acceleration path of the drive-in ram (13) that is longer than the expansion path of the drive spring (31).

11. A drive-in tool according to claim 10, wherein a transmission ratio of conversion of the expansion path of the drive spring (31) into the acceleration path of the drive-in ram is equal to 1:2.

12. A hand-held spring drive-in power tool for driving in fastening elements, comprising, a guide (12); a drive-in ram (13) displaceable in the guide (13); drive means (30) for driving the drive-in ram (13) and including at least one preloaded drive spring (31); a support element (35) for supporting the drive spring (31) at one end of the drive spring (31); a tensioning device (70) for at least one preloaded drive spring (31); a tensioning device (70) for preloading the drive spring (31); a transmission element (33) for transmitting a tensioning force from the tensioning device (70) to the drive spring (31); at least one roller (34) for guiding the transmission element (33); and at least one rolling bearing for supporting the at least one roller (34) on the support element (35) on a side of the support element (35) remote from the drive spring (31).

13. A drive-in tool according to claim 12, wherein the drive spring (31) is supported against a tool housing (10) at another, opposite end of the drive spring (31).

14. A drive-in tool according to claim 12, wherein the drive spring (31) is supported, at the another, opposite and thereof against an abutment (36) fixedly secured to the housing (10).

* * * * *